US009695655B2

(12) United States Patent
Kaasa et al.

(10) Patent No.: US 9,695,655 B2
(45) Date of Patent: Jul. 4, 2017

(54) CONTROL METHOD AND APPARATUS FOR WELL OPERATIONS

(75) Inventors: Glenn-Ole Kaasa, Stavanger (NO); Kjetil Fjalestad, Skien (NO)

(73) Assignee: STATOIL PETROLEUM AS, Stavanger (NO)

( * ) Notice: Subject to any disclaimer, the term of this patent is extended or adjusted under 35 U.S.C. 154(b) by 1053 days.

(21) Appl. No.: 13/497,471

(22) PCT Filed: Sep. 21, 2010

(86) PCT No.: PCT/EP2010/063865

§ 371 (c)(1),
(2), (4) Date: Apr. 2, 2012

(87) PCT Pub. No.: WO2011/036144

PCT Pub. Date: Mar. 31, 2011

(65) Prior Publication Data

US 2012/0247831 A1 Oct. 4, 2012

(30) Foreign Application Priority Data

Sep. 22, 2009 (GB) ..... 0916628.1

(51) Int. Cl.
*E21B 21/08* (2006.01)

(52) U.S. Cl.
CPC ..... *E21B 21/08* (2013.01)

(58) Field of Classification Search
CPC ..... E21B 21/00; E21B 21/08; E21B 21/10; E21B 21/103; E21B 21/106; E21B 47/06; E21B 47/10
See application file for complete search history.

(56) References Cited

U.S. PATENT DOCUMENTS 3,993,100 A * 11/1976 Pollard ..... E21B 33/035 137/628
4,185,652 A * 1/1980 Zintz ..... E21B 33/0355 137/628
5,975,219 A 11/1999 Sprehe
(Continued)

FOREIGN PATENT DOCUMENTS

WO WO 2008/016717 A2 2/2008
WO WO 2008/051978 A1 5/2008
WO WO 2008051978 A1 * 5/2008 ..... E21B 21/08

OTHER PUBLICATIONS

Nakagawa, et al. "Application of aerated-fluid drilling in deep water", World Oil, Gulf Publishing Company, Houston, TX, US, vol. 220, No. 6, pp. 47-50, Jun. 1, 1999, XP-000831481.

*Primary Examiner* — Jennifer H Gay
*Assistant Examiner* — David Carroll
(74) *Attorney, Agent, or Firm* — Birch, Stewart, Kolasch & Birch, LLP

(57) ABSTRACT

A method of controlling the annular pressure in a well during a well construction operation. The operation comprises pumping a fluid down a tubing located within the well and extracting the fluid that flows back through an annulus within said well and surrounding the tubing. The method comprises defining a set pressure pref, determining a desired extraction flow rate qc of fluid from said annulus in dependence upon the set pressure pref and a pumped flow rate into the annulus, and configuring an extraction path to achieve said desired extraction flow rate.

17 Claims, 3 Drawing Sheets

(56) References Cited

U.S. PATENT DOCUMENTS

| | | | | |
|---|---|---|---|---|
| 2003/0079912 | A1* | 5/2003 | Leuchtenberg | E21B 21/08 175/38 |
| 2003/0168258 | A1 | 9/2003 | Koederitz | |
| 2005/0092523 | A1 | 5/2005 | McCaskill et al. | |
| 2006/0037781 | A1 | 2/2006 | Leuchtenberg | |
| 2007/0151762 | A1 | 7/2007 | Reitsma | |
| 2007/0227774 | A1 | 10/2007 | Reitsma et al. | |
| 2010/0288507 | A1* | 11/2010 | Duhe et al. | 166/370 |

* cited by examiner

CONTROL METHOD AND APPARATUS FOR WELL OPERATIONS

The present invention relates to a control method and apparatus for well operations, for example well drilling and completion and well control. The invention is applicable in particular, though not necessarily, to so-called Managed Pressure Drilling (MPD).

The International Association of Drilling Contractors (IADC) defines MPD as "an adaptive drilling process used to more precisely control the annular pressure profile throughout a wellbore." MPD systems comprise a closed pressure system for providing automatic control of the backpressure within a wellbore during a drilling process [or other drilling and completion operations]. Existing MPD solutions employ conventional feedback control, using proportional plus integral (PI), and possibly proportional plus integral plus derivative (PID), feedback from the pressure of the fluid within the wellbore annulus to control one or more chokes and/or pumps manipulating the extraction of fluid from the wellbore. Some systems utilise direct control, which comprises stabilising the downhole pressure at a given desired pressure set point. A real-time hydraulic model may be used to compute the downhole annulus pressure during drilling, e.g. based upon the measured topside pressure. Alternatively, in some systems, the downhole pressure is measured directly and relayed topside using high speed drill string telemetry. Other systems utilise indirect control, attempting to stabilise the topside upstream choke pressure to a set point corresponding to a desired downhole pressure. A real-time hydraulic model is used to compute a choke pressure corresponding to the desired downhole pressure.

Such existing systems are based on conventional feedback control technology, which results in some fundamental shortcomings with respect to robustness and performance. In particular, existing systems suffer from poor robustness against disturbances, typically because high gain is required in the controller to achieve a fast response to pressure variations. Lack of robustness is particularly troublesome in the case of gas passing through the choke, causing chattering in the control input.

Furthermore, existing systems also suffer from degraded performance during critical operations, particularly pump ramp-up/down and drill string movements. The performance of existing systems may also degrade without re-tuning of controller parameters during drilling (primarily because the length of the well increases, and thus the effective stiffness of the hydraulic system decreases).

Model Predictive Control (MPC) is a general control methodology for model-based control which has been proposed for improved pressure control in MPD systems in an effort to solve the above problems. However, proposed solutions using MPC are related to the type of model which has been used, which are either: highly advanced dynamic models of the annular pressure dynamics based on partial differential equations, which are computationally demanding and numerically non-robust, thus making them unsuitable for robust control; or simple empirical models which require continuous updating/tuning of several model parameters, which again makes them unsuitable for practical implementation. Proposed solutions using MPC applied to MPD are at present not mature enough for practical use and have been primarily of academic interest. Consequently, no MPC-solutions have ever been implemented for MPD.

The following patent documents are concerned with MPD systems; WO2008016717, US2005269134, US2005092523, US2005096848, GB2447820, and U.S. Pat. No. 7,044,237.

It is an object of the present invention to overcome or at least mitigate the aforementioned problems with known MPD systems. This object is achieved at least in part by using a determined pressure offset to calculate a desired extraction flow rate from the wellbore annulus. The choke valve(s) or pumps, or indeed any appropriate type of flow control device, in the extraction path are set to achieve this desired extraction rate.

According to a first aspect of the present invention there is provided a method of controlling the annular pressure in a well during a well construction operation. The operation comprises pumping a fluid down a tubing located within the well and extracting the fluid that flows back through an annulus within said well and surrounding the tubing. The method comprises defining a set pressure $p_{ref}$, determining a desired extraction flow rate $q_c$ of fluid from said annulus in dependence upon the set pressure $p_{ref}$ and a pumped flow rate into the annulus, and configuring an extraction path to achieve said desired extraction flow rate.

Embodiments of the invention offer improved robustness against disturbances, and in particular sudden disturbances within the well, as well as reducing or even eliminating the need for returning of control parameters during an operation in order to maintain system stability.

The step of determining a desired extraction flow rate may be additionally made in dependence upon a determined or estimated influx or efflux $q_{res}$ through the well walls or a part of the well walls.

The method of the invention may comprise determining a fluid pressure p within said annulus and determining a pressure offset of the determined pressure p with respect to said set pressure $p_{ref}$, said step of determining a desired extraction flow rate being additionally made in dependence upon said pressure offset. In this case, the step of determining a fluid pressure within the annulus may comprise measuring a fluid pressure at a downhole end of the annulus. The step of determining a fluid pressure within the annulus may comprise measuring a fluid pressure at a topside end of the annulus.

The step of using said pressure offset to determine a desired extraction flow rate of fluid from the annulus may comprise scaling said pressure offset to compensate for compression of the fluid within the annulus. The pressure offset may be scaled by a factor $V_a/\beta_a$, where $V_a$ is the volume of said annulus and $\beta_a$ is the effective bulk modulus of the fluid within said annulus.

The step of using said pressure offset to determine a desired extraction flow rate of fluid from the annulus may comprise further scaling said pressure offset by a constant gain factor $K_p$.

The step of determining a desired extraction flow rate $q_c$ may comprise evaluating at least one of the following terms:

- $\dot{V}_a$, where $\dot{V}_a$ is the rate of change of the volume of a wellbore annulus within the system;
- $q_{bit}$, wherein $q_{bit}$ is the flow of fluid into the annulus through a bottom hole apparatus;

$q_{res}$, wherein $q_{res}$ is i the flow of fluid into the annulus from a reservoir; and $\dot{p}_{ref}$, scaled with $$\frac{V_a}{\beta_a},$$

wherein $\dot{p}_{ref}$ is the rate of change of the said set pressure $p_{ref}$ More particularly, the step of determining a desired extraction flow rate $q_c$ may comprise summing two or more of the evaluated terms.

The step of determining a desired extraction flow rate $q_c$ may comprise summing one or more of the evaluated terms listed above, with a pressure offset term.

The step of determining a desired extraction flow rate from the annulus may be additionally made in dependence upon a determined or estimated rate of change of a volume $\dot{V}_a$ of the wellbore, excluding the displacement volume of the tubing and any attached bottom hole apparatus.

The method may comprise determining a flow rate $q_{bit}$ through a bottom hole apparatus attached to an end of the tubing in order to provide said pumped flow rate into the annulus.

The step of determining a desired extraction flow rate $q_c$ may comprise evaluating the equation $$q_c = -\alpha\dot{V}_a + \delta q_{bit} + \lambda q_{res} + \phi\frac{V_a}{\beta_a}\dot{p}_{ref} + \gamma\left[\frac{V_a}{\beta_a}K_p g(p, p_{ref}, t)\right]$$

where $V_a$ is the volume of the wellbore annulus, $\dot{V}_a$ is the rate of change of $V_a$, $q_{bit}$ is the flow of fluid into the annulus through a bottom hole apparatus, $q_{res}$ is the flow of fluid into the annulus from a reservoir, $\dot{p}_{ref}$ is the rate of change of $p_{ref}$, $\beta_a$ is the effective bulk modulus of the fluid in the annulus, $K_p$ is the controller gain, and wherein at least two of $\alpha$, $\delta$, $\lambda$, $\phi$ and $\gamma$=1, and each of the remaining two of $\alpha$, $\delta$, $\lambda$, $\phi$ and $\gamma$=0 or 1. The function $g(p,p_{ref},t)$ may be $p-p_{ref}$, or a nonlinear, time-varying, monotonically increasing function of $p-p_{ref}$. Argument t in the function $g(p,p_{ref},t)$ denotes that the g may also be dependent on time-varying inputs.

The step of configuring an extraction path to achieve said desired extraction flow rate may comprise setting the operating points of one or more valves and/or pumps (e.g. a pressure back pump and/or downhole pump) in the extraction path.

By way of example, the well construction operation in which the method is employed may be one of drilling; drilling during start and/or stop of a rig pump; drilling during power loss at the rig pump; tripping of a tubing into the well; cementing of the well; and fishing within the well.

According to a second aspect of the present invention there is provided a controller for controlling the pressure within an annulus during a well construction operation, the operation comprising pumping a fluid down a tubing and extracting the fluid that flows back through an annulus within said wellbore and surrounding the tubing, the controller comprising:

a pressure setting unit for defining a set pressure $p_{ref}$;

a flow rate determiner for determining a desired extraction flow rate $q_c$ of fluid from said annulus in dependence upon the set pressure $p_{ref}$ and a pumped flow rate into the annulus; and a flow rate setting unit for configuring an extraction path to achieve said desired extraction flow rate.

The controller may further comprise a processor for determining a rate of change of the set pressure, $\dot{p}_{ref}$.

According to a third aspect of the present invention there is provided a method of controlling the annular pressure in a well during a well contraction operation, the operation comprising pumping a fluid down a tubing located within the well and extracting the fluid that flows back through an annulus within said well and surrounding the tubing, the method comprising:

determining a fluid pressure p within said annulus and determining a pressure offset of the determined pressure p with respect to a set pressure $p_{ref}$;

using said pressure offset to determine a desired extraction flow rate $q_c$ of fluid from said annulus; and configuring an extraction path to achieve said desired extraction flow rate.

According to a fourth aspect of the present invention there is provided a controller for controlling the pressure within an annulus during a well construction operation, the operation comprising pumping a fluid down a tubing and extracting the fluid that flows back through an annulus within said wellbore and surrounding the tubing, the controller comprising:

a pressure monitor for determining a fluid pressure p within said wellbore and for determining a pressure offset of the determined pressure p with respect to a set pressure $p_{ref}$;

a flow rate determiner for using said pressure offset to determine a desired extraction flow rate $q_c$ of fluid from said annulus; and a flow rate setting unit for configuring an extraction path to achieve said desired extraction flow rate.

According to a fifth aspect of the present invention there is provided a method of controlling the annular pressure in a well during a well construction operation, the operation comprising pumping a fluid down a tubing located within the well and extracting the fluid that flows back through an annulus within said well and surrounding the tubing, the method comprising:

determining a desired extraction flow rate $q_c$ of fluid from said annulus in dependence upon a rate of change of volume $\dot{V}_a$ of a wellbore annulus and a pumped flow rate into the annulus; and configuring an extraction path to achieve said desired extraction flow rate.

The method of this fifth aspect of the invention may comprise determining a fluid pressure p within said annulus and determining a pressure offset of the determined pressure p with respect to a set pressure $p_{ref}$, said step of determining a desired extraction flow rate being additionally made in dependence upon said pressure offset. In this case, the step of determining a fluid pressure within the annulus may comprise measuring a fluid pressure at a downhole end of the annulus. The step of determining a fluid pressure within the annulus may comprise measuring a fluid pressure at a topside end of the annulus.

The step of determining a desired extraction flow rate $q_c$ may comprise evaluating at least one of the following terms:

$-\dot{V}_a$, where $\dot{V}_a$ is the rate of change of the volume of a wellbore annulus within the system;

$q_{bit}$, wherein $q_{bit}$ is the flow of fluid into the annulus through a bottom hole apparatus;

$q_{res}$, wherein $q_{res}$ is the flow of fluid into the annulus from a reservoir; and $\dot{p}_{ref}$, scaled with $$\frac{V_a}{\beta_a},$$

wherein $\dot{p}_{ref}$ is the rate of change of the said set pressure $p_{ref}$.

One or more of these may be added to a pressure offset term.

In particular, the step of determining a desired extraction flow rate $q_c$ comprise evaluating the equation $$q_c = -\alpha\dot{V}_a + \delta q_{bit} + \lambda q_{res} + \phi\frac{V_a}{\beta_a}\dot{p}_{ref} + \gamma\left[\frac{V_a}{\beta_a}K_p g(p, p_{ref}, t)\right].$$

At least certain embodiments of the invention can provide a controller structure which utilises a simple model of the dynamics of the annular downhole pressure in order to provide an improved method of pressure control during well construction operations, e.g. well drilling. Whereas existing in-use systems are based on conventional feedback control and do not utilise a knowledge of the system which is controlled, these embodiments provide a control structure which utilises the dominating inherent physical system properties to provide an intelligent compensation of the disturbances and operations that affect the pressure during drilling. Unlike the proposed solutions based upon Model-Predictive Control, the control structure has a simple structure which enables a simple and robust implementation. In particular, it does not require an advanced hydraulic model or extensive tuning of an empirical model. The control structure is physically justified and is flexible and modular. Since the control structure is based on a simple model with lumped physical parameters, it provides robust algorithms for automatic calibration and tuning Embodiments of the invention may improve pressure compensation during various operations such as pump ramp-up/shut-down and drill string movements. Compensation may also be provided for pressure fluctuation due to heave (when drilling from a floater), whilst the need to tune the controller during drilling may be reduced or even eliminated.

For a better understanding of the present invention and in order to show how the same may be carried into effect, reference will now be made by way of example to the accompanying drawings, in which.

Figure 1:
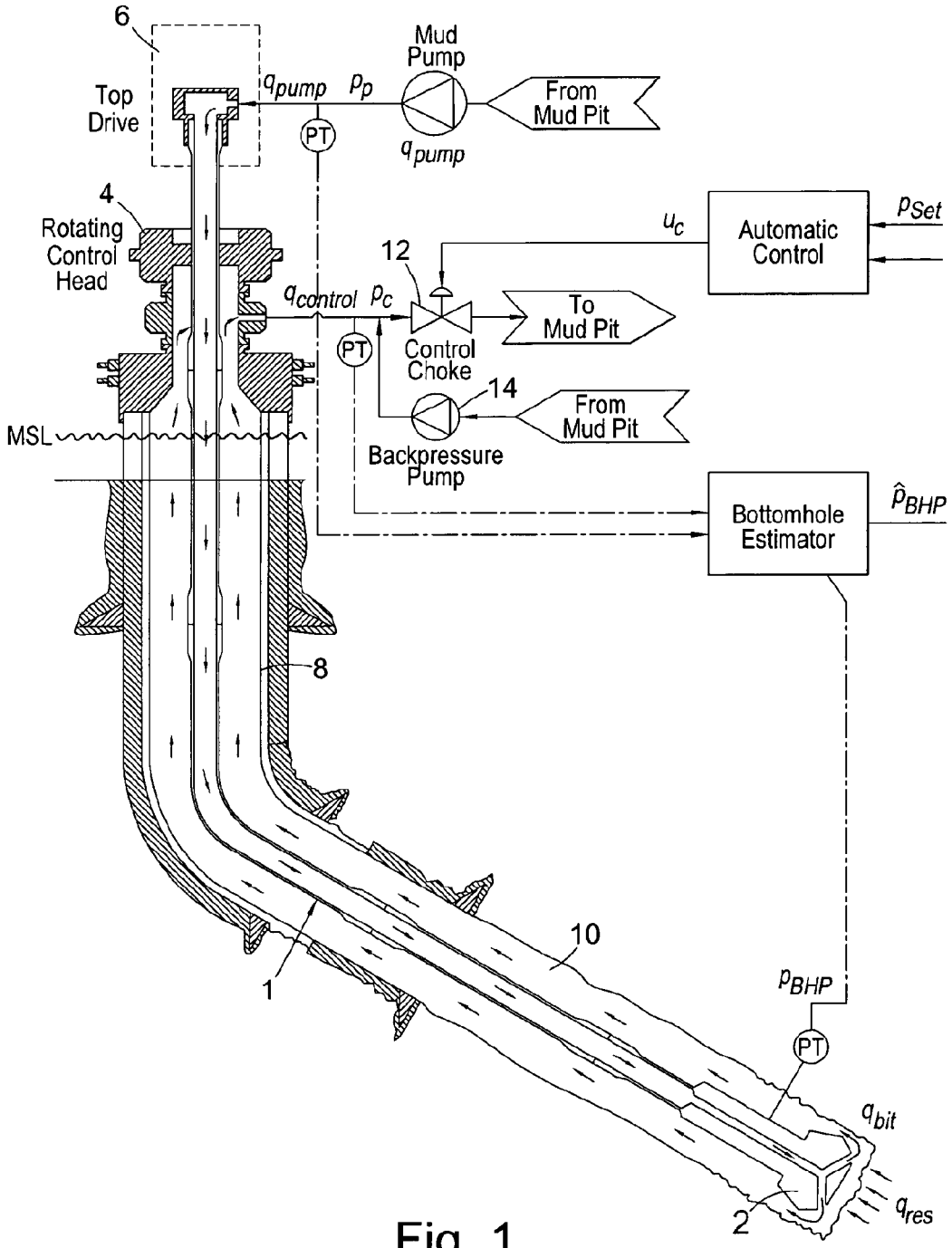
FIG. 1 illustrates schematically a Managed Pressure Drilling (MPD) system.

FIG. 1 shows a Managed Pressure Drilling (MPD) system comprising a drill string 1 having a drill bit 2, a control head 4 and a top drive 6. A wellbore 8 defines an annulus 10 between the wellbore 8 and the drill string 1, and containing drilling fluid. During operation, drilling fluid is pumped from the top drive 6, at a flow $q_{pump}$, down the drill string 1 to power the drill bit 2. In most cases the rotation of the drill bit is powered by the top drive 6 which rotates the entire drill string. However, in some cases the fluid flow may also cause the rotation of the drill bit. Often, the fluid flow powers a turbine that generates power for downhole sensors and transmitters used transmit data signals to the surface by pulse telemetry. The drilling fluid exits through the drill bit 2 into the downhole annulus and returns up through the annulus 10. Upon reaching the topside of the annulus, the drilling fluid exits the annulus at a flow $q_c$. The flow rate $q_c$ is a variable that is controlled so as to maintain a predetermined pressure profile within the annulus 10. For example, the flow $q_c$ can be controlled by a control choke 12 and backpressure pump 14 which maintains sufficient backpressure within the MPD system. Fluid may also enter or exit the annulus 10 via the reservoir (for example through pores in the wellbore at a flow $q_{res}$.

The dynamics of the average pressure in the annulus 10 can be described by the model:

$$\frac{V_a}{\beta_a}\dot{p} = -\dot{V}_a + q_{bit} + q_{res} - q_c \tag{1}$$

where p is the annulus pressure (either downhole, or topside), $V_a$ is the annulus volume containing drilling fluid (in a "dual-gradient" system, only a part of the riser is filled with drilling fluid), which primarily depends on the length of the well and the position of the drill string, $\dot{V}_a$ is the rate of volume change, i.e. the time-derivative of the volume, and $\beta_a$ is the bulk modulus, which is a lumped parameter describing the effective stiffness of the liquid in the annulus, including the effect of entrained gas in the drilling fluid and the resulting flexibility of the drill string, casing and well. The flow $q_{bit}$ is the flow into the annulus through the drill bit, and $q_{res}$ is the effective reservoir influx, typically composed of influx from or loss to the reservoir, according to $$q_{res} = q_{influx} - q_{loss} \tag{2}$$

The flow $q_c$ is the controlled flow out of the annulus topside which is typically composed of the flow through the choke manifold, and make-up from the back pressure pump according to $$q_c = q_{choke1} + q_{choke2} - q_{back} \tag{3}$$

The simplified model, given by Equation (1), forms the basis for the pressure control method. It should be noted that by tuning the effective bulk modulus $\beta_a$, Equation (1) can be used to describe the pressure in the annulus at fixed locations in the well, such as the downhole end and the topside. This means that the controller structure based on Equation (1) can be applied to both a direct and indirect pressure control scheme.

In implementing a controller employing the model of Equation (1), it is assumed that the volume $V_a$ and its rate of change with time $\dot{V}_a$ can be measured or otherwise determined (or estimated), for example based upon the known length of the drill string within the wellbore, the cutting diameter of the drill bit, the diameter of the drill string, and the rate of movement of the string into and out of the wellbore. It is further assumed that the bit flow $q_{bit}$ is available, either measured directly, or estimated/computed from indirect measurements, and that the reservoir flow $q_{res}$ and the bulk modulus $\beta_a$ can be estimated, either offline or online.

Based on the above assumptions, the basic controller model can be given as $$q_c = -\dot{V}_a + q_{bit} + q_{res} + \frac{V_a}{\beta_a}K_p(p - p_{ref}) \tag{4}$$

-continued $$= \alpha_{ss} + \alpha_{pump} + \alpha_{res} + \alpha_{feedback} \quad (5)$$

where $p_{ref}$ is the desired pressure. The various terms of the controller structure have clear interpretations which are described in detail below. However, it will be appreciated that one or more of the terms may be removed from the model, whilst benefits over known MPD systems can still be obtained. It should be noted that, depending on the type of drilling operations to which the present invention is applied, some of the terms in Equation (4) may be removed. Terms may be removed temporarily depending upon drilling events. For example, the $\alpha_{feedback}$ term may be removed temporarily upon detection of a "kick" in the well, i.e. when a sizeable inflow of fluid into the well from the reservoir occurs, or when the drill string is rapidly moved within the wellbore. In such a case, the set pressure $p_{ref}$ becomes the pressure within the annulus immediately before the event (i.e. $\alpha_{feedback}$ is zero), such that the extraction rate is set to maintain the status quo within the well.

The first term in Equation (4) is $$\alpha_{ss} = -\dot{V}_a \quad (6)$$

and is the feed-forward surge and swab compensation. This term compensates for the volume change and resulting pressure changes caused by movement of the drill string relative to the well. This term is thus important during tripping operations, and is particularly important in case of drilling from a floater in order to compensate for the pressure fluctuations caused by heave. This term provides an improvement over the conventional PI controller during such operations, thus improving transient performance and removing potential problems with integrator windup.

The second term in Equation (4) is $$\alpha_{pump} = q_{bit} \quad (7)$$

and is the feed-forward compensation from the pump flow. This provides an improvement in the compensation of pressure fluctuations caused by startup/stop of the mud pumps compared to the conventional PI controller. Using $q_{bit}$, rather than the actual pump flow $q_{pump}$, also takes into account the transient periods of pressure build-up/down in the drill string during pump start/stop.

The third term in Equation (4) is $$\alpha_{res} = q_{res} \quad (8)$$

which represents the compensation of the disturbance (represented here as influx from the reservoir), or the model error caused in the simplified model according to Equation (1). This term may be estimated to obtain integral action in the controller equivalent to the integral term in the conventional PI controller. $\alpha_{res}$ is not usually used to compensate reservoir flow, but rather compensates for other modelling errors in the design model.

The fourth and final term in Equation (4) is $$\alpha_{feedback} = \frac{V_a}{\beta_a} K_p (p - p_{ref}) \quad (9)$$

and is the feedback correction term which is needed to obtain good robustness and disturbance rejection properties of the controller. This term is equivalent to the proportional feedback control term $K_p(p-p_{ref})$ of the conventional PI controller. The scaling by $V_a/\beta_a$ implements a gain scheduling which eliminates the effect of volume change on the effective stiffness of the system. The scaling also compensates for changes in the effective bulk modulus (i.e. inverse of compressibility) of the system. This term mitigates any degradation in performance as drilling progresses and the increased volume causes the stiffness of the well to reduce. This term also enables the controller gain $K_p$ to be preset, thus eliminating the need to tune to individual wells.

In order to implement the controller structure according to the described model, it is necessary to control the total annulus flow by controlling the flow $q_c$ according to Equation (3). For example, this can be achieved by manipulating the flow through one of main chokes $q_{choke1}$ or $q_{choke2}$. Alternatively, the flow can be controlled by the flow through the make-up pump $q_{back}$, or by a combination of the chokes and the make-up pump.

Figure 2:
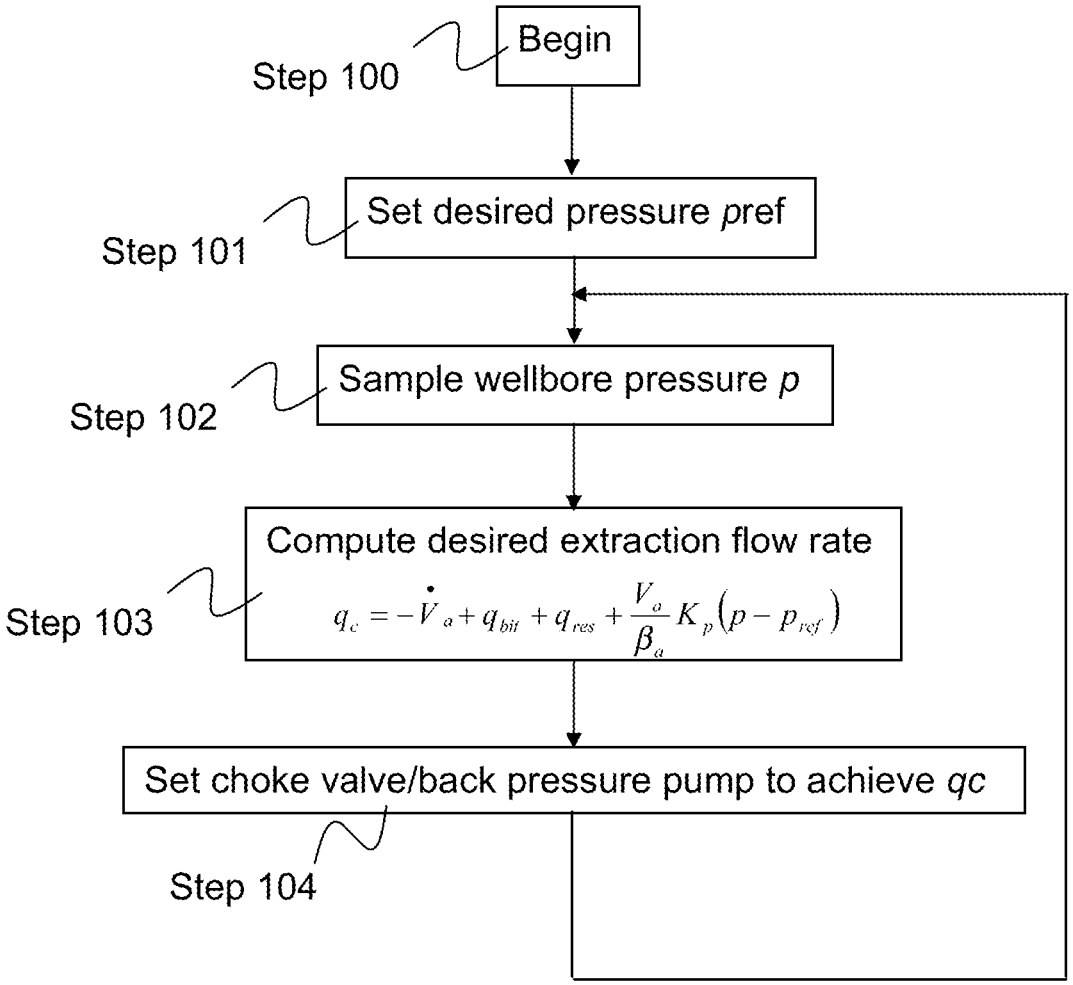
FIG. 2 is a flow diagram of a Managed Pressure Drilling process.

FIG. 2 is a flow diagram illustrating the main steps in the MPD control process. The process begins at step 100, and at step 101 the desired pressure is set, for example by a skilled operator inputting this pressure into the control system. At step 102, the annular downhole pressure is sampled, e.g. by measuring the pressure in the open hole part from the last casing shoe to the bottom of the hole, e.g. at or close to the casing shoe or close to the drill bit, and relaying this to the topside control system. [The pressure may alternatively be sampled at other downhole locations.] At step 103, equation (4) above is evaluated, using the measured pressure and other measured or estimated parameters. At step 104, the evaluated fluid flow rate is used to set the operating points of the flow control devices, e.g. the choke valve and/or the back pressure pump.

Figure 3:
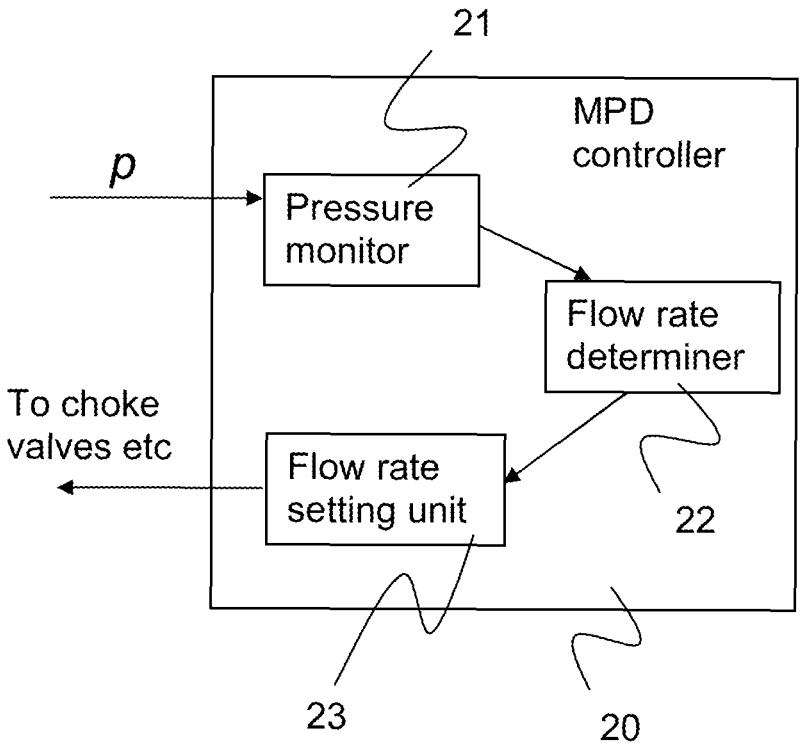
FIG. 3 illustrates schematically a controller of the Managed Pressure Drilling (MPD) system of FIG. 1.

FIG. 3 illustrates schematically a MPD controller 20 which may be implemented using, for example, an appropriately programmed computer. The controller comprises a pressure monitor 21 for determining a downhole annulus pressure at some predefined point in the open hole. This value may be provided directly from a pressure sensor, or may be estimated based upon some measured parameter(s). The pressure determined by the pressure monitor 21 is passed to a flow rate determinator 22 which is configured to evaluate equation (4) above. The determined extraction flow rate is then passed to a flow rate setting unit 23 which determines set (operating) points for the flow control device(s). The set values are distributed to the appropriate components in the extraction path.

The model defined by equation (4) above may be further enhanced by including a term relating to the rate of change of the desired pressure $p_{ref}$, namely $\dot{p}_{ref}$. The modified equation becomes:

$$q_c = -\alpha \dot{V}_a + \delta q_{bit} + \lambda q_{res} + \phi \frac{V_a}{\beta_a} \dot{p}_{ref} + \gamma \left[ \frac{V_a}{\beta_a} K_p (p - p_{ref}) \right] \quad (10)$$

In practise, $p_{ref}$ and its time-derivative $\dot{p}_{ref}$ are derived simply by applying a filter so that $p_{ref}$ is actually a filtered version of the actual desired setpoint input $p_{ref}$ (0).

Referring to equations (4) and (10) above, it is further noted that the error term $(p-p_{ref})$ may be replaced by a generalised error function $g(p-p_{ref})$ where g is any appropriate non-linear, monotonically increasing function, possibly time varying. Examples include:

i) nonlinear, symmetric: $g(p, p_{ref}, t) = (p-p_{ref})^3$ ii) nonlinear, symmetric: $g(p, p_{ref}, t) = (p-p_{ref}) + (p-p_{ref})^3$ iii) nonlinear, asymmetric: $g(p, p_{ref}, t) = p^3 - p_{ref}^2$ iv) nonlinear, symmetric, time varying: $g(p, p_{ref}, t) = (p-p_{ref}) + (p-p_{ref})^3 * \exp(-t)$ v) linear, time varying $g(p, p_{ref}, t)=(p-p_{ref})*x(t)$, where x may be any time varying input.

It will be appreciated by the person of skill in the art that various modifications may be made to the above described embodiments without departing from the scope of the present invention. The control strategy may be used in many type of operations in the well construction process, ranging from drilling to completion, such as for example pressure control during cementing, fishing of broken drill pipe, or well control situations (e.g. start and/or stop of a rig pump and power loss at the rig pump), etc. The control strategy is applicable in dual gradient systems, where there is typically a subsea pump which extracts drilling fluid from the annulus at some location between the seabed and the topside, and which allows manipulation of the level of drilling fluid in the riser. The drill bit referred to in the embodiment described above is, in this case, only an example of a bottom hole apparatus that is attached to the tubing.

The invention claimed is:

1. A method of controlling the annular pressure in a well during a well construction operation, the operation comprising pumping a fluid down a tubing located within the well and extracting the fluid that flows back through an annulus within said well and surrounding the tubing, the method comprising:

defining a set pressure $p_{ref}$;

determining a fluid pressure p within said annulus and determining a pressure offset of the determined pressure p with respect to said set pressure $p_{ref}$;

calculating a desired extraction flow rate $q_c$ of fluid from said annulus based on an analytical model depending upon the set pressure $p_{ref}$, said pressure offset scaled by a constant gain factor $K_p$, and a pumped flow rate into the annulus; and configuring an extraction path to achieve said desired extraction flow rate.

2. The method according to claim 1, said step of determining a desired extraction flow rate being additionally made in dependence upon a determined or estimated influx or efflux $q_{res}$ through the well walls or a part of the well walls.

3. The method according to claim 1, wherein said step of determining a fluid pressure within the annulus comprises measuring a fluid pressure at a downhole end of the annulus.

4. The method according to claim 1, wherein said step of determining a fluid pressure within the annulus comprises measuring a fluid pressure at a topside end of the annulus.

5. The method according to claim 1, wherein a step of using said pressure offset to determine a desired extraction flow rate of fluid from the annulus comprises scaling said pressure offset to compensate for compression of the fluid within the annulus.

6. The method according to claim 1, wherein said pressure offset is scaled by a factor $V_a/\beta_a$, where $V_a$ is the volume of said annulus and $\beta_a$ is the effective bulk modulus of the fluid within said annulus.

7. The method according to claim 1, wherein said step of determining a desired extraction flow rate $q_c$ comprises evaluating at least one of the following terms:

$-\dot{V}_a$, where $\dot{V}_a$ is the rate of change of the volume of a wellbore annulus within the system;

$q_{bit}$, wherein $q_{bit}$ is the flow of fluid into the annulus through a bottom hole apparatus;

$q_{res}$, wherein $q_{res}$ is the flow of fluid into the annulus from a reservoir; and $\dot{p}_{ref}$, scaled with $$\frac{V_a}{\beta_a},$$

wherein $\dot{p}_{ref}$ is the rate of change of the said set pressure $p_{ref}$.

8. The method according to claim 7, wherein said step of determining a desired extraction flow rate $q_c$ comprises summing two or more of the evaluated terms.

9. The method according to claim 1, said step of determining a desired extraction flow rate from the annulus being additionally made in dependence upon a determined or estimated rate of change of a volume $\dot{V}_a$ of the wellbore, excluding the displacement volume of the tubing and any attached bottom hole apparatus.

10. The method according to claim 1, and further comprising determining a flow rate $q_{bit}$ through a bottom hole apparatus attached to an end of the tubing in order to provide said pumped flow rate into the annulus.

11. The method according to claim 1, wherein said step of configuring an extraction path to achieve said desired extraction flow rate comprises setting the operating points of one or more valves and/or a pressure back pump in the extraction path.

12. The method according to claim 1, wherein said well construction operation is one of: drilling; drilling during start and/or stop of a rig pump; drilling during power loss at the rig pump; tripping of a tubing into the well; cementing of the well; and fishing within the well.

13. The method according to claim 1, said step of determining a desired extraction flow rate $q_c$ comprising evaluating the equation $$q_c = -\alpha\dot{V}_a + \delta q_{bit} + \lambda q_{res} + \gamma\left[\frac{V_a}{\beta_a}K_p g(p, p_{ref}, t)\right]$$

where $V_a$ is the volume of the wellbore annulus, $\dot{V}_a$ is the rate of change of $V_a$, $q_{bit}$ is the flow of fluid into the annulus through a bottom hole apparatus, $q_{res}$ is the flow of fluid into the annulus from a reservoir, $\beta_a$ is the effective bulk modulus of the fluid in the annulus, $K_p$ is the controller gain, g is $p-p_{ref}$, or a nonlinear, time-varying, monotonically increasing function of $p-p_{ref}$, and wherein at least two of $\alpha$, $\delta$, $\lambda$ and $\gamma=1$, and each of the remaining two of $\alpha$, $\delta$, $\lambda$ and $\gamma=0$ or 1.

14. The method according to claim 1, said step of determining a desired extraction flow rate $q_c$ comprising evaluating the equation $$q_c = -\alpha\dot{V}_a + \delta q_{bit} + \lambda q_{res} + \phi\frac{V_a}{\beta_a}\dot{p}_{ref} + \gamma\left[\frac{V_a}{\beta_a}K_p g(p, p_{ref}, t)\right]$$

where $V_a$ is the volume of the wellbore annulus, $\dot{V}_a$ is the rate of change of $V_a$, $q_{bit}$ is the flow of fluid into the annulus through a bottom hole apparatus, $q_{res}$ is the flow of fluid into the annulus from a reservoir, $\beta_a$ is the effective bulk modulus of the fluid in the annulus, $K_p$ is the controller gain, g is $p-p_{ref}$ or a nonlinear, time-varying, monotonically increasing function of $p-p_{ref}$, and wherein at least two of α, δ, λ, ϕ and γ=1, and each of the remaining two of α, δ, λ, ϕ and γ=0 or 1.

15. A controller for controlling the pressure within an annulus during a well construction operation, the operation comprising pumping a fluid down a tubing and extracting the fluid that flows back through an annulus within said wellbore and surrounding the tubing, the controller comprising:

a pressure setting unit for defining a set pressure $p_{ref}$, a pressure monitor for determining a fluid pressure p within said wellbore and for determining a pressure offset of the determined pressure p with respect to the set pressure $p_{ref}$, a flow rate determiner for using said pressure offset to determine a desired extraction flow rate $q_c$ of fluid from said annulus, wherein the desired extraction flow rate $q_c$ of fluid from said annulus is calculated based on an analytical model depending upon the set pressure $p_{ref}$, said pressure offset scaled by a constant gain factor $K_p$, and a pumped flow rate into the annulus; and a flow rate setting unit for configuring an extraction path to achieve said desired extraction flow rate.

16. The controller according to claim 15, said flow rate determiner being configured to determine a desired extraction flow rate $q_c$ by evaluating the equation $$q_c = -\alpha\dot{V}_a + \delta q_{bit} + \lambda q_{res} + \gamma\left[\frac{V_a}{\beta_a}K_p g(p, p_{ref}, t)\right]$$

where $V_a$ is the volume of the wellbore annulus, $\dot{V}_a$ is the rate of change of $V_a$, $q_{bit}$ is the flow of fluid into the annulus through a bottom hole apparatus, $q_{res}$ is the flow of fluid into the annulus from a reservoir, $\beta_a$ is the effective bulk modulus of the fluid in the annulus, $K_p$ is the controller gain, g is $p-p_{ref}$, or a nonlinear, time-varying, monotonically increasing function of $p-p_{ref}$, and wherein at least two of α, δ, λ and γ=1, and each of the remaining two of α, δ, λ and γ=0 or 1.

17. The controller according to claim 15, said flow rate determiner being configured to determine a desired extraction flow rate $q_c$ by evaluating the equation $$q_c = -\alpha\dot{V}_a + \delta q_{bit} + \lambda q_{res} + \phi\frac{V_a}{\beta_a}\dot{p}_{ref} + \gamma\left[\frac{V_a}{\beta_a}K_p g(p, p_{ref}, t)\right]$$

where $V_a$ is the volume of the wellbore annulus, $\dot{V}_a$ is the rate of change of $V_a$, $q_{bit}$ is the flow of fluid into the annulus through a bottom hole apparatus, $q_{res}$ is the flow of fluid into the annulus from a reservoir, $\beta_a$ is the effective bulk modulus of the fluid in the annulus, $K_p$ is the controller gain, g is $p-p_{ref}$, or a nonlinear, time-varying, monotonically increasing function of $p-p_{ref}$, and wherein at least two of α, δ, λ, ϕ and γ=1, and each of the remaining two of α, δ, λ, ϕ and γ=0 or 1.

* * * * *